US009082323B1

(12) United States Patent
Dougherty et al.

(10) Patent No.: US 9,082,323 B1
(45) Date of Patent: Jul. 14, 2015

(54) SIGN HOLDER BRACKET AND DISPLAY SYSTEM

(71) Applicant: TARGET BRANDS, INC., Minneapolis, MN (US)

(72) Inventors: Kristin A. Dougherty, Chaska, MN (US); April D. Jackson, Golden Valley, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/245,698

(22) Filed: Apr. 4, 2014

(51) Int. Cl.
*G09F 7/18* (2006.01)

(52) U.S. Cl.
CPC ..... *G09F 7/18* (2013.01); *G09F 2007/1843* (2013.01); *G09F 2007/1852* (2013.01)

(58) Field of Classification Search
USPC ..... 40/600, 606.19
See application file for complete search history.

(56) References Cited

U.S. PATENT DOCUMENTS

| | | | | |
|---|---|---|---|---|
| 2,876,359 | A | | 3/1959 | Plymale |
| 4,344,244 | A | | 8/1982 | Tyke |
| 4,408,407 | A | | 10/1983 | Bloom et al. |
| 4,472,897 | A | | 9/1984 | Phillips |
| 4,677,780 | A | | 7/1987 | Shuman |
| 4,960,258 | A | | 10/1990 | Stocker et al. |
| 5,029,378 | A | * | 7/1991 | Stocker et al. ..... 29/462 |
| 5,483,779 | A | | 1/1996 | Crawford et al. |
| 5,609,317 | A | | 3/1997 | Glynn et al. |
| 5,664,749 | A | * | 9/1997 | Kump et al. ..... 248/220.22 |
| 6,015,124 | A | | 1/2000 | Loy |
| D608,836 | S | | 1/2010 | Kosir |
| 7,946,066 | B2 | | 5/2011 | Wamsley |
| 8,234,805 | B2 | | 8/2012 | Dukes et al. |
| 2013/0263486 | A1 | | 10/2013 | Logan et al. |

OTHER PUBLICATIONS

Office Action from Canadian Patent Application No. 2,848,551, mailed Aug. 7, 2014 (3 pages).
Office Action from Canadian Patent Application No. 2,848,551, mailed Jan. 16, 2015 (4 pages).

* cited by examiner

*Primary Examiner* — Joanne Silbermann
(74) *Attorney, Agent, or Firm* — JoAnn M. Seaton; Griffiths & Seaton PLLC

(57) ABSTRACT

A display system includes a bracket and a sign. The bracket includes a base and a reception portion coupled to the base. The reception portion includes a first sidewall, a second sidewall, and an intermediate wall. The first sidewall and the second sidewall each extend from opposing longitudinal sides of the intermediate wall over the base. The sign includes a front panel, a rear panel, and a bottom panel, the rear panel being spaced from the front panel to define a cavity between the front panel and the rear panel. The bottom panel defines an aperture. The reception portion of the bracket slides into the cavity via the aperture, and each of the first sidewall and the second sidewall of the reception portion abuts an internal surface of a different one of the first panel and the second panel of the sign to frictionally maintain the sign above the base.

24 Claims, 15 Drawing Sheets

SIGN HOLDER BRACKET AND DISPLAY SYSTEM

BACKGROUND OF THE INVENTION

Retail businesses typically use a wide variety of display systems to display product and related information to consumers. In order to draw attention to the products displayed and/or to assist the consumer in locating the particular product for which they are searching, additional signs or other indicating means are becoming increasingly important. Such signs are typically mounted to the display systems to indicate the type of product, brand of product, advertising, sale status indicator, department, or other information relating to the displayed products and generally helpful to the consumer.

The above-described signs are generally positioned to correspond with particular products placed on shelves, pegs, or other display devices. Preferably, such signs are securely mounted to the shelf or display system, are effective in communicating the indicated information such as the product type, brand name, logo, etc. to the consumer, and are aesthetically pleasing to consumers so as not to distract from the product display itself.

SUMMARY OF THE INVENTION

One aspect of the present invention relates to a display system including a bracket and a sign. The bracket includes a base and a sign reception portion coupled to the base. The sign reception portion includes a first sidewall, a second sidewall, and an intermediate wall. The first sidewall and the second sidewall each extend from opposing longitudinal sides of the intermediate wall over the base. The sign includes a front panel, a rear panel, and a bottom panel, the rear panel being spaced from the front panel to define an internal cavity between the front panel and the rear panel. The bottom panel extends between the front panel and the rear panel. The bottom panel defines an aperture. The sign reception portion of the bracket slides into the internal cavity via the aperture, and each of the first sidewall and the second sidewall of the sign reception portion abuts an internal surface of a different one of the first panel and the second panel of the sign to frictionally maintain the sign above the base. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

The present invention relates to a sign holder bracket and associated display assembly for use, for example, in a retail store or related setting. Sign holder brackets are configured to magnetically and selectively couple to a top spine of a gondola display or more particular, with a variety of different gondola displays. Each sign holder bracket includes a base with lower magnetic bar and an elongated top section extending upwardly from the base. The elongated top section has a U-shaped or otherwise similarly shaped cross-section for interfacing with a sign. A sign for use with one or more sign holder brackets is formed of a substantially rigid material such as foam core, cardboard, plastic, or similar having a bottom, substantially planar panel. The bottom, substantially planar panel includes a number of apertures equal to the number of sign holder brackets being used therewith, and each aperture has a shape corresponding to the cross-sectional shape of the elongated top extension of the sign holder bracket. As such, each sign holder bracket slidably receives a sign by sliding the sign onto the elongated top extension thereof via a corresponding aperture in the bottom, substantially planar panel of the sign. In one embodiment, each sign interfaces with one or more, and in one example, two or more, of the sign holder brackets such that each sign is maintained at a top of a gondola display systems extending substantially in parallel with a top spine of the included gondola.

Figure 1:
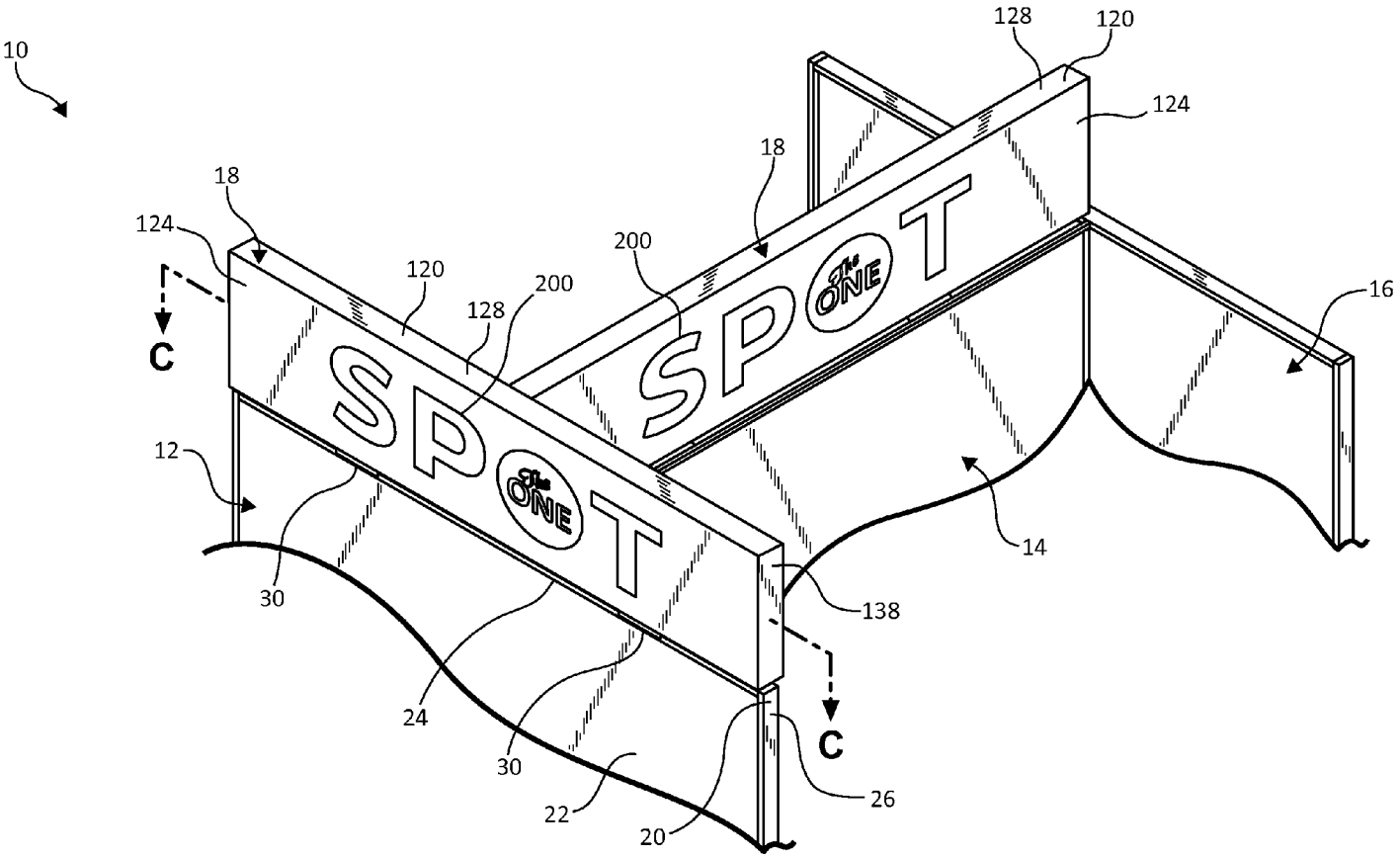
FIG. 1 is a partial, front perspective view illustration of a display system, according to one embodiment of the present invention.
Figure 2:
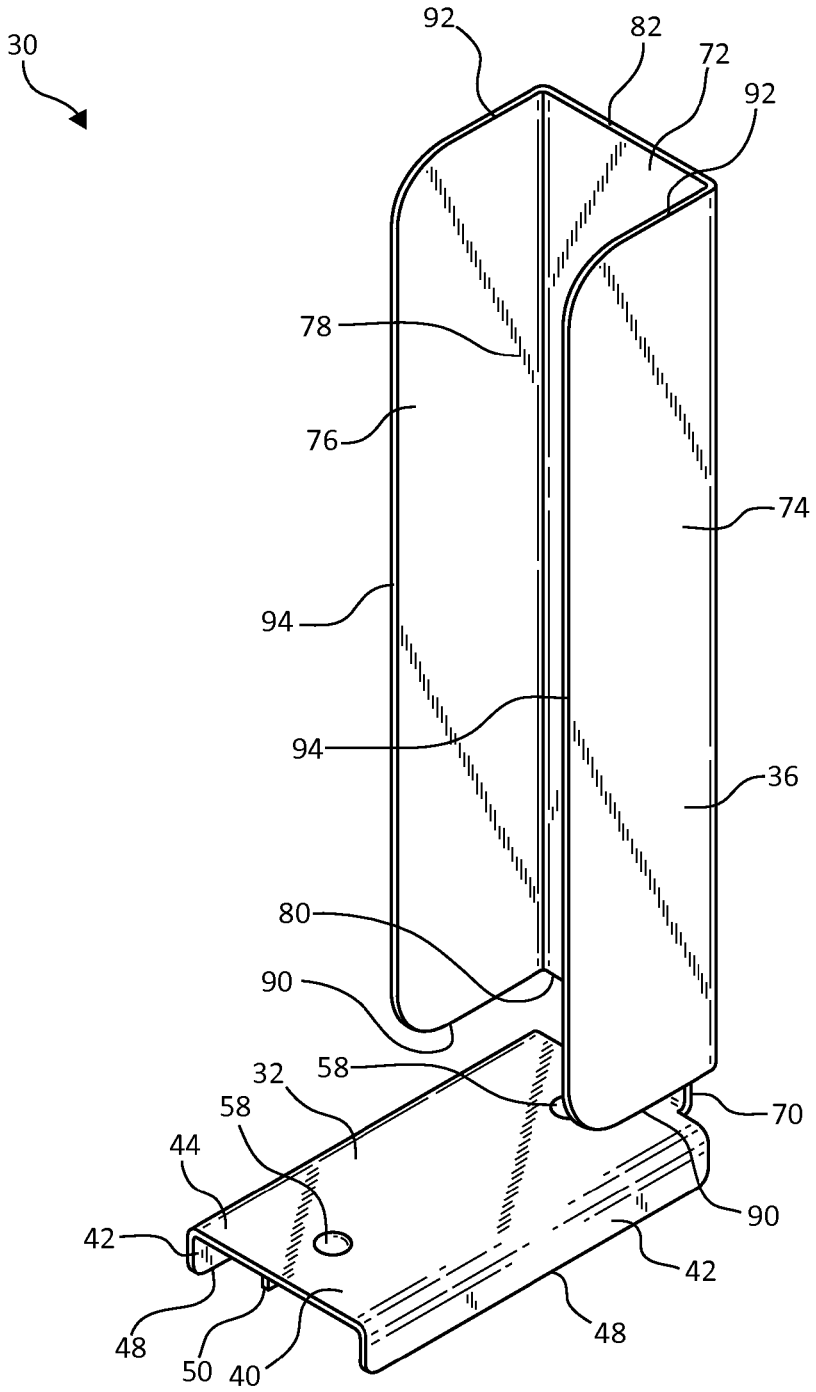
FIG. 2 is front perspective view illustration of a magnetic sign holder bracket of FIG. 1, according to one embodiment of the present invention.
Figure 3:
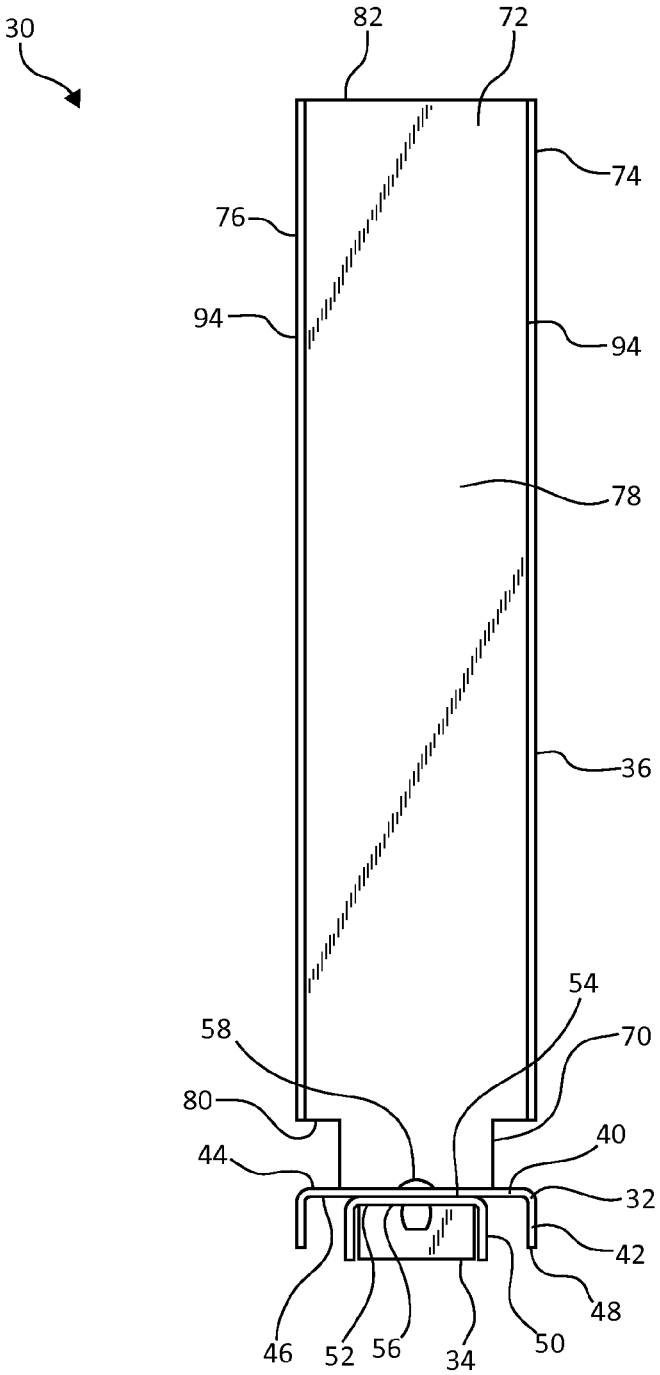
FIG. 3 is a front view illustration of the magnetic sign holder bracket of FIG. 1, according to one embodiment of the present invention.
Figure 4:
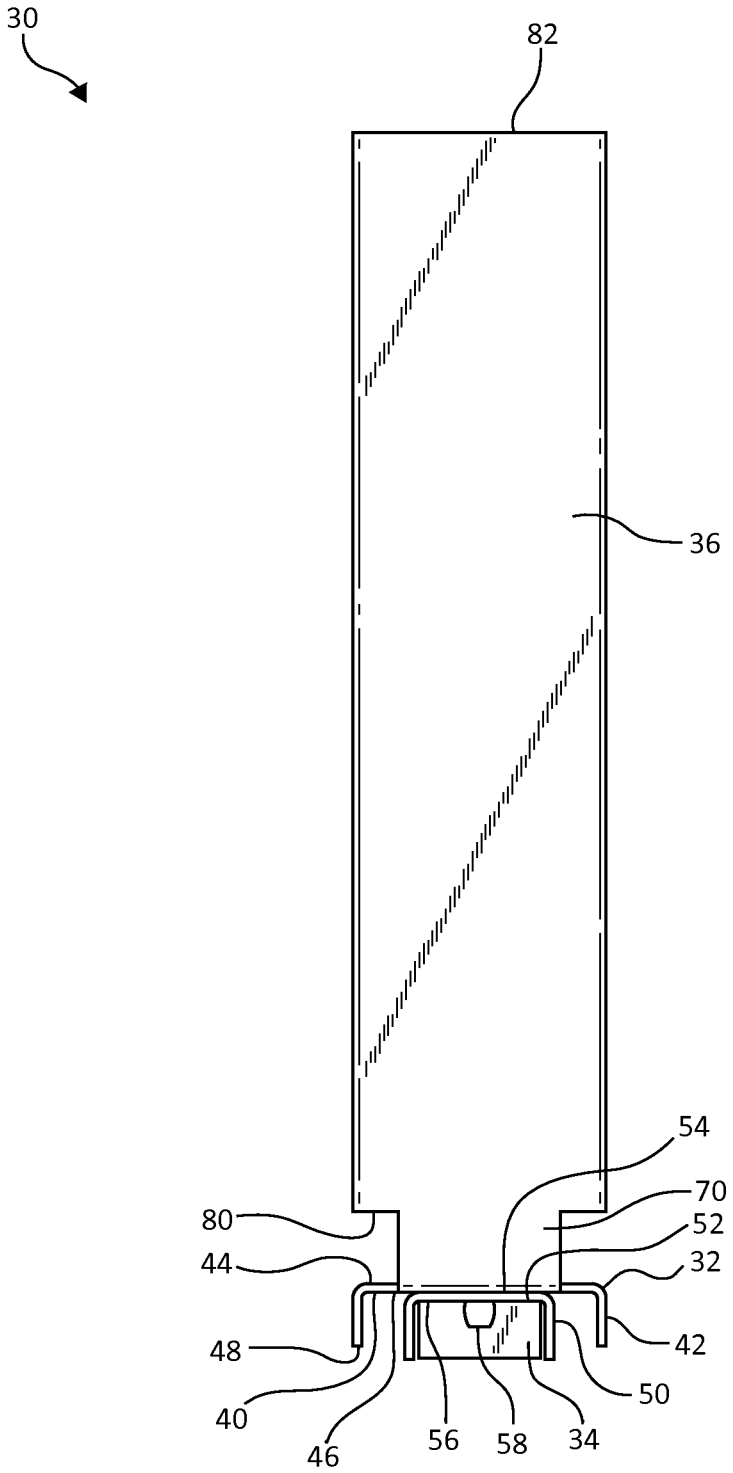
FIG. 4 is a rear view illustration of the magnetic sign holder bracket of FIG. 1, according to one embodiment of the present invention.
Figure 5:
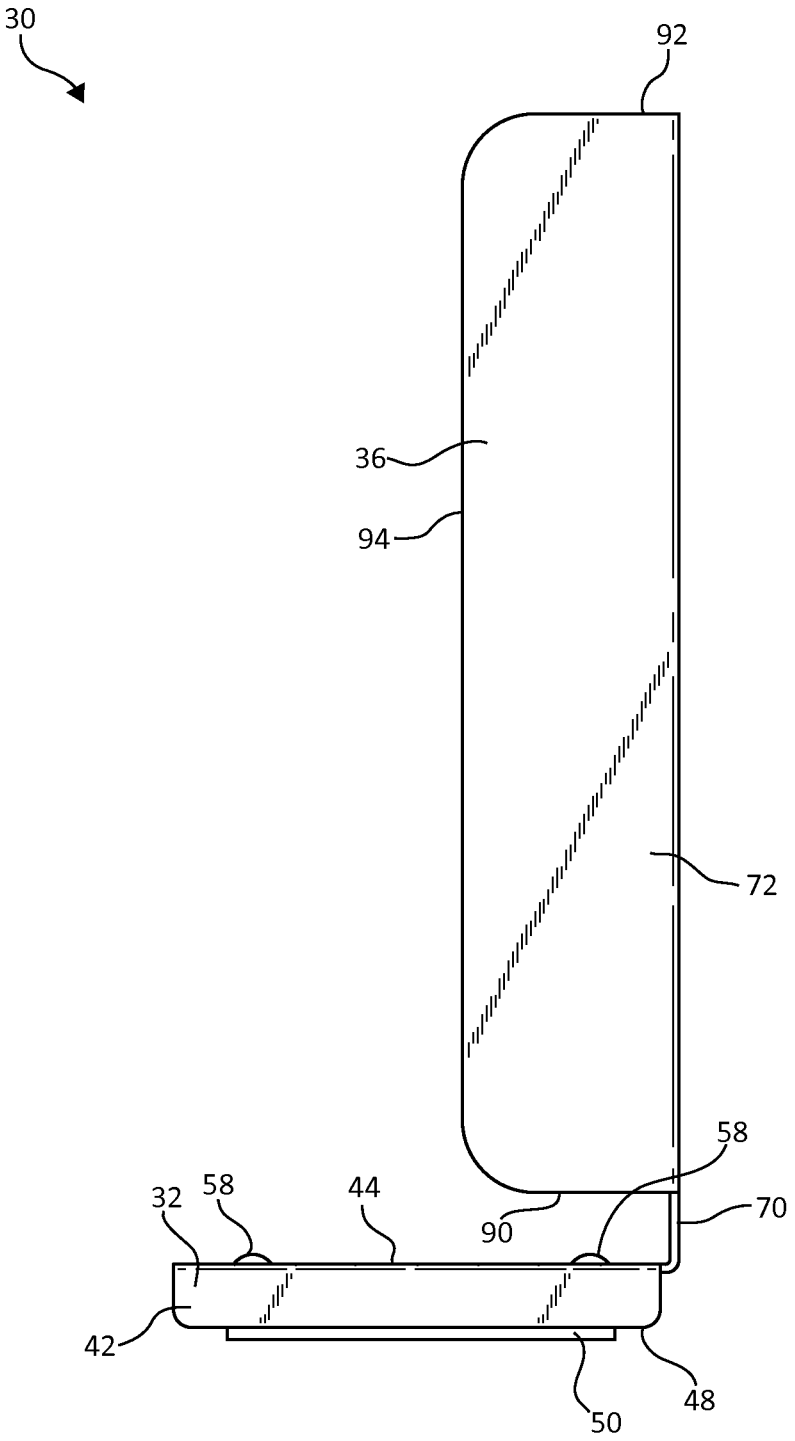
FIG. 5 is a right side view illustration of the magnetic sign holder bracket of FIG. 1 where the left side view is a mirror image of the right side view, according to one embodiment of the present invention.
Figure 6:
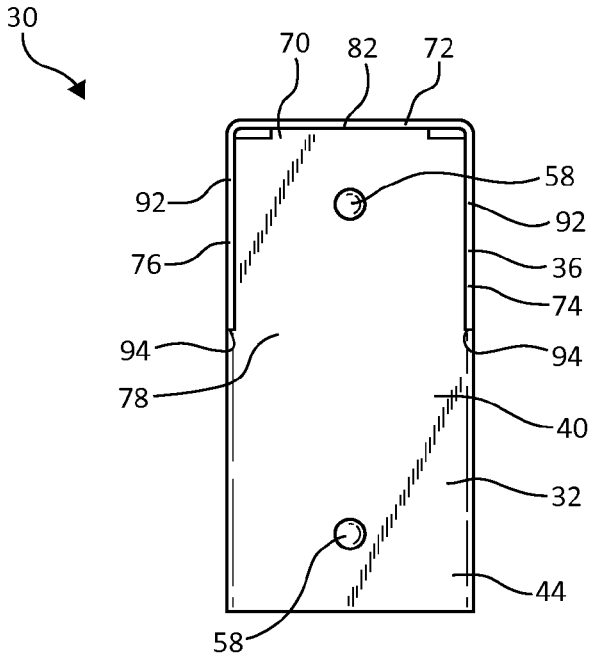
FIG. 6 is a top view illustration of the magnetic sign holder bracket of FIG. 1, according to one embodiment of the present invention.
Figure 7:
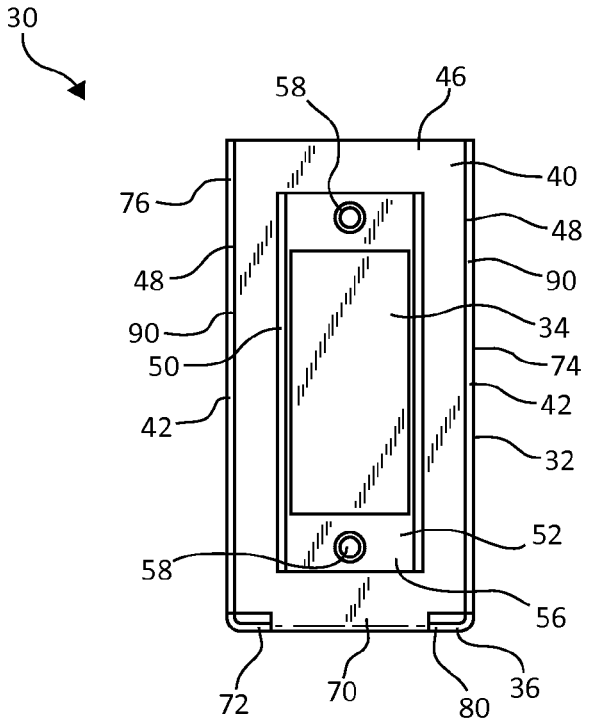
FIG. 7 is a bottom view illustration of the magnetic sign holder bracket of FIG. 1, according to one embodiment of the present invention.

Turning to the figures, FIG. 1 illustrates a display system 10 including gondola units 12, 14, and 16 with one or more signs 18 mounted thereon. Each gondola unit 12, 14, and 16 is a two-sided unit including a frame 20 with side panels 22. Each frame 20 is formed of a sturdy material such as steel or other suitable, magnetic material. Each frame 20 includes a linear top spine 24 extending from one of opposing side supports 26 to the other and above a base or decking (not shown) there below. Each sign 18 is elongated and extends along and, in one example, substantially covers a substantially entirety of a length of top spine 24 of a gondola unit 12, 14, or 16.

The at least one sign 18 is coupled to one or more gondola units 12, 14, and 16 using a number, for example, two, sign holder brackets 30, as illustrated in FIGS. 2-7. In the illustrated embodiment, each bracket 30 includes a base 32, a magnet 34, and an upwardly extending top or sign reception portion 36. In one embodiment, base 32 is formed as an inverted channel including a substantially planar panel 40 and depending sidewalls 42. Substantially planar panel 40 defines a top surface 44 and a bottom surface 46 opposite top surface 44. In one example, base 32 includes two of depending sidewalls 42 extending along opposing, elongated side edges of substantially planar panel 40 and extending substantially parallel to one another.

The magnet 34 is coupled with bottom surface 46, for example, via mounting member 50 or other suitable mounting member, device, or substance. In one example, mounting member 50 is also provided in the form of an inverted channel including a primary panel 52 at a top thereof defining a top surface 54 and a bottom surface 56. Mounting member 50 is formed from a suitably rigid material such as steel. In one embodiment, mounting member 50 is alternatively a substantially planar member with no depending sidewalls.

Magnet 34 is any suitable magnet having sufficient strength to maintain signs 18 on gondola units 12, 14, and 16 (FIGS. 1, 8, and 15) in a manner generally preventing inadvertent removal of such signs 18 therefrom. Magnet 34, for example, a bar-shaped ceramic magnet secured to bottom surface 56 with glue or other suitable fastening agent such that the results in magnet 34 and mounting member 50 combination being rated to withstand at least 25 pounds of pull. In one example, sidewalls of mounting member 50 substantially cover sides of magnet 34 to protect magnet 34 from damage that may be caused by external forces.

Top surface 54 of mounting member 50 faces and/or is placed in contact with bottom surface 46 of substantially planar panel 40 of base 32 and rigidly secured thereto via suitable fasteners 58, such as fasteners 58 extending through apertures (not shown) in each of mounting member 50 and substantially planar panel 40. In one example, when mounting member 50 is coupled with substantially planar panel 40 of base 32, magnet 34 and, in one example, mounting member 50 extend below bottom free edges 48 of depending sidewalls 42 of base 32.

In one example, bracket 30 includes a neck 70 extending away from an edge (e.g., a rear edge as depicted in FIGS. 2-7) of substantially planar panel 40 and upwardly to sign reception portion 76 of bracket 30. In one example, neck 70 has an overall width less than overall widths of base 32 and sign reception portion 76, in one example, widths less than widths of an intermediate wall 72 of sign reception portion and of substantially planar panel 40 of base 32. In one example, neck 70 is formed with a substantially L-shape having a substantially perpendicular bend formed in a middle portion thereof. In one example, neck 70 transitions from an extension substantially coplanar with substantially planar portion 40 to be substantially coplanar with intermediate wall 72 of sign reception portion 76.

In addition to intermediate wall 72, sign reception portion 76 includes first sidewall 74 and second sidewall 76. Intermediate wall 72, first sidewall 74, and second sidewall 76 collectively define a C-shaped channel portion of bracket 30 with an open channel 78 being formed therebetween and having an open side opposite intermediate wall 72. More specifically, intermediate wall 72 extends substantially vertically from a bottom edge 80 immediately adjacent neck 70 to an opposing top edge 82. In one embodiment, intermediate wall 72 is substantially planar and elongated such that its height is greater than its width, for example, at least about two times greater, and in one embodiment, at least about four times greater. Each of first sidewall 74 and second sidewall 76 extend along and from opposing longitudinal sides of intermediate wall 72 to extend over base 32. In one embodiment, each of first sidewall 74 and second sidewall 76 are substantially planar and/or has a substantially identical overall height and width as intermediate wall 72. Each of first sidewall 74 and second sidewall 76 extend in a plane positioned substantially perpendicular to a plane in which intermediate panel 82 extends in one example.

Each of first sidewall 74 and second sidewall 76 extends between a bottom edge 90 and a top edge 92 thereof. In one embodiment, bottom edges 90 of first sidewall 74 and second sidewall 76 and bottom edge 80 of intermediate wall 72 are substantially coplanarly positioned, and/or top edges 92 of first sidewall 74 and second sidewall 76 and top edge 82 of intermediate wall 72 are substantially coplanarly positioned. Each of first sidewall 74 and second sidewall 76 extends from a respective opposing longitudinal edge of intermediate wall 72 to a free longitudinal edge 94. In one example, each of intermediate wall 72, first sidewall 74, second sidewall 76, and free longitudinal edges 94 of first sidewall 74 and second sidewall 76 extend in a direction substantially perpendicular to substantially planar panel 40 of base 32. According to one embodiment, top edges 92 of first sidewall 74 and second sidewall 76 and top edge 82 of intermediate panel collectively define a C-shaped edge of sign support portion 36 of bracket 30.

In one embodiment, base 32, neck 70, and sign reception portion 36 are all formed of a single piece of material, such a bent sheet metal. Each bracket 30 is configured for installation on a top of one of gondola units 12, 14, and 16 as illustrated with additional reference to FIGS. 8 and 9. For example, magnet 34 contacts a top surface 100 of top spine 24, which is substantially planar in one embodiment. Since top spine 24 is metallic, bracket 30 is secured thereto via magnetic force from magnet 34. In one example, as illustrated in FIG. 9, depending sidewalls 42 of base 32 of bracket 30 extend beyond opposing sides of top spine 24 and top surface 100 thereof. In one example, bottom edges of mounting member 50 also contact top surface 100 providing additional stability to bracket 30 on top surface 100 of top spine 24.

Figure 8:
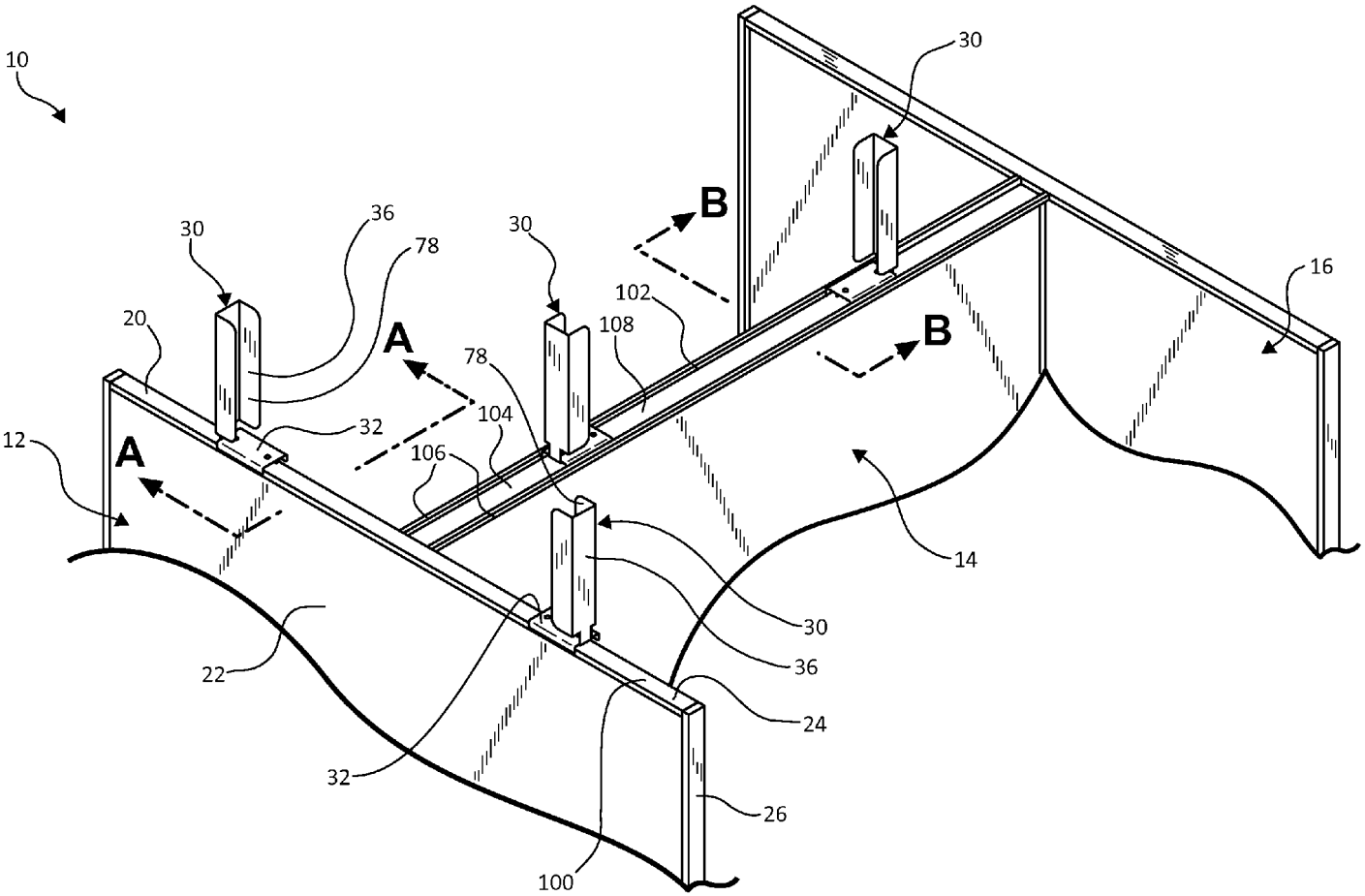
FIG. 8 is a partial, front perspective view illustration of the display system of FIG. 1 with signs removed, according to one embodiment of the present invention.
Figure 9:
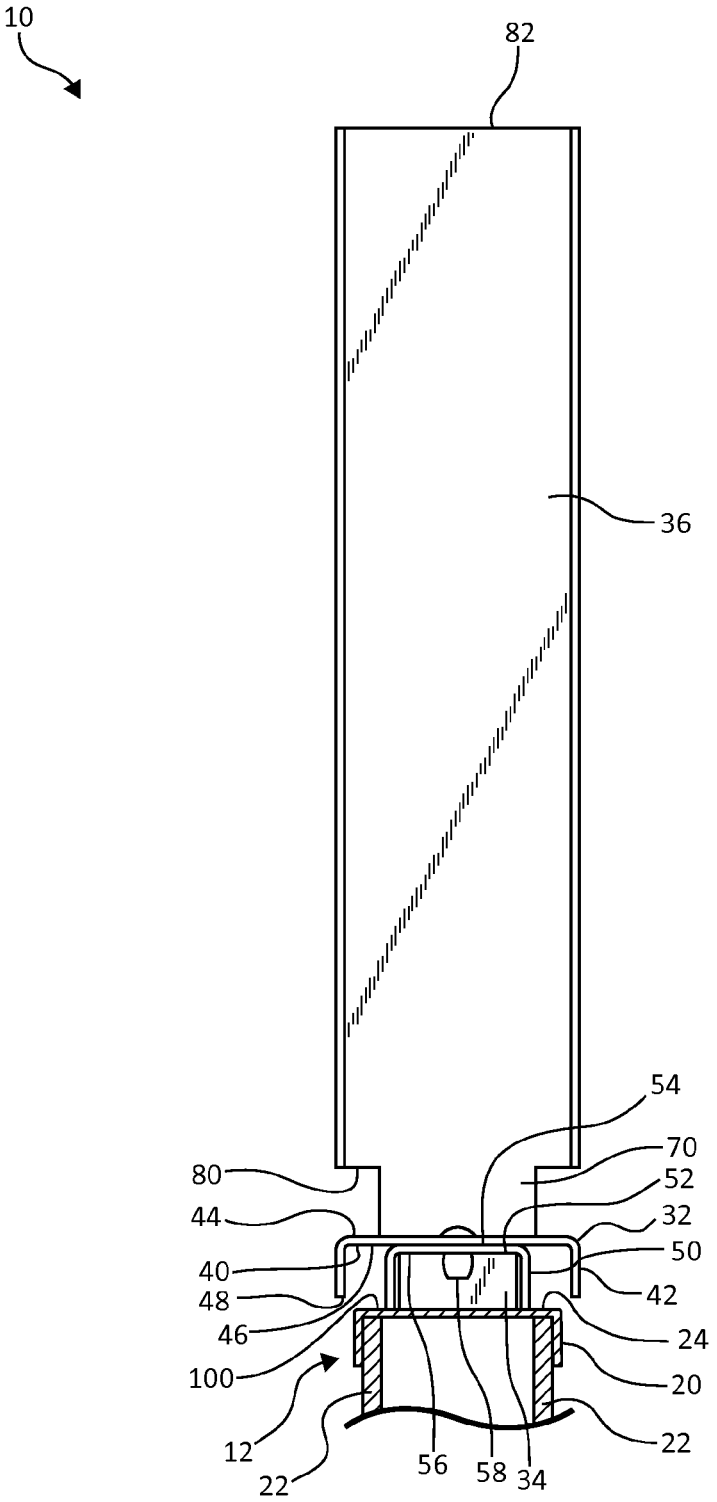
FIG. 9 is a partial cross-sectional view illustration taken about the line A-A in FIG. 8, according to one embodiment of the present invention.
Figure 10:
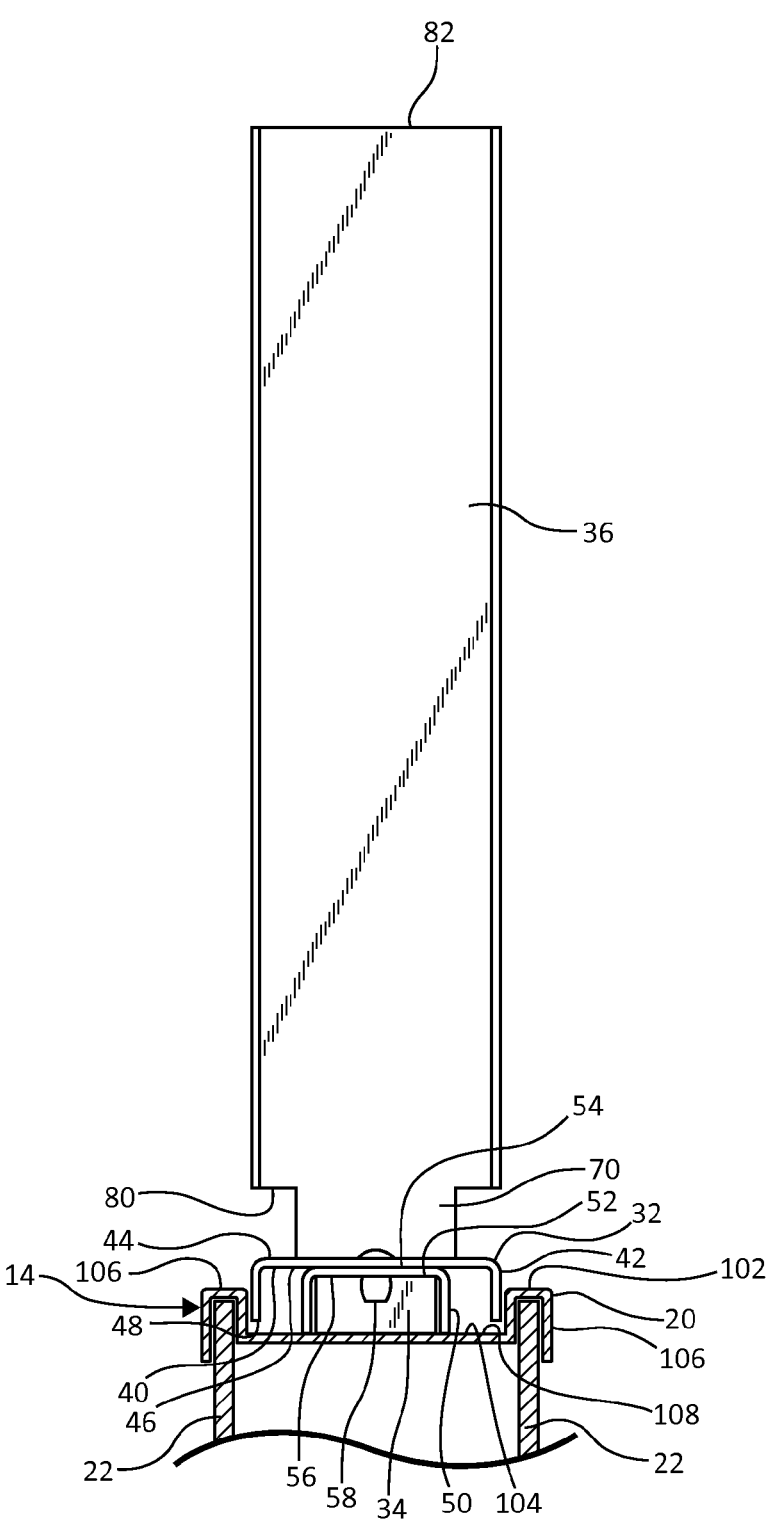
FIG. 10 is a partial cross-sectional view illustration taken about the line B-B in FIG. 8, according to one embodiment of the present invention.

Bracket 30 is also configured for use with gondola units 14 formed slightly differently than gondola unit 12 with an alternative top spine 102 as shown with reference to FIGS. 8 and 10. More specifically, in one example, top spine 102 includes a substantially planar, primary top surface 104 having a raised side edge 106 on each of opposing sides of primary top surface 104 such that an open channel 108 is formed above primary top surface 104 between side edges 106. In this embodiment, magnet 34 of bracket 30 directly interfaces with primary top surface 104 and depending sidewalls 42 fit between opposite raised side edges 106. In both of the examples shown in FIGS. 9 and 10, bracket 30 extends upwardly from its securement to top spine 24 or 102 in a secure manner such that one or more brackets 30 securely receive and maintain sign 18 (FIG. 1) as will be further described below.

Figure 11:
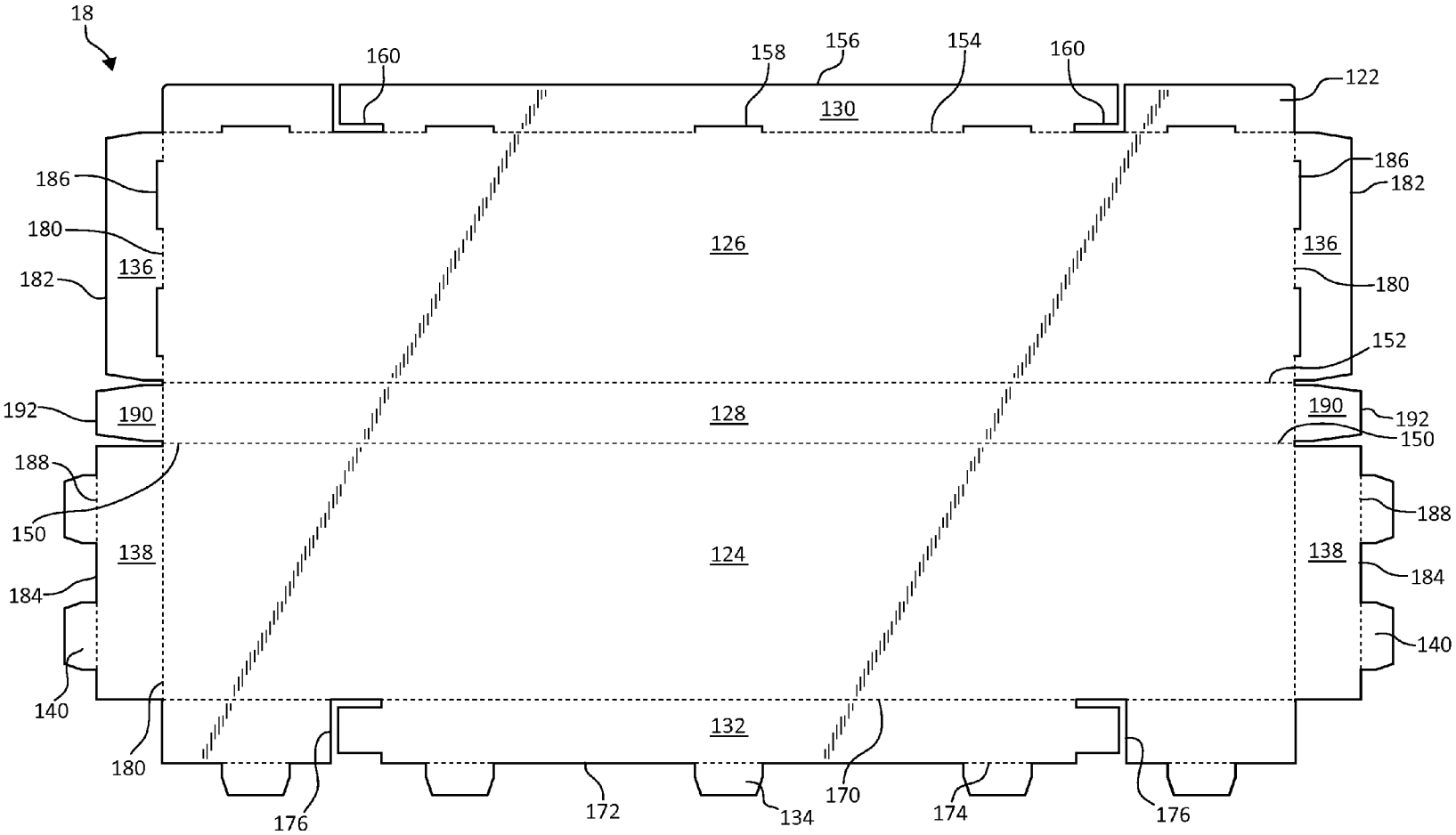
FIG. 11 is a front view of an unfolded sign blank, according to one embodiment of the present invention.

One example of an unfolded sign 18 for use with brackets 30 is illustrated in FIG. 11. Sign 18 is cut or otherwise formed from a substantially planar material having an exterior surface 120 and an interior surface 122. Sign 18 is divided into a series of panels and tabs via fold lines and perimeter and/or interior cut lines. For example, sign 18 includes a first or front panel 124, a second or rear panel 126, a top panel 128, an interior bottom panel 130, and an exterior bottom panel 132, which are all elongated and have substantially identical overall lengths. In one example, sign 18 additionally includes bottom securement tabs 134, interior side panels 136, exterior side panels 138, and/or side securement tabs 140. When folded, sign 18 is provided in the form of a cuboid having rectangular or square sides as illustrated, for example, in FIGS. 1 and 15, with interior bottom panel 130, bottom securement tabs 134, interior side panels 136, and side securement tabs 140 being substantially hidden from view. In one example, top panel 128, interior bottom panel 130, and exterior bottom panel have substantially identical lateral dimensions that will define an overall width of sign 18, while front panel 124 and rear panel 126 define larger lateral dimensions that will define an overall height of sign 18.

More particularly, top panel 128 is bordered on each longitudinal side by a different one of longitudinal fold lines 150 and 152. Front panel 124 laterally extends from longitudinal fold line 150 to longitudinal fold line 170. In one embodiment, exterior bottom panel 132 laterally extends from longitudinal fold line 170 opposite front panel 124 to a free longitudinal edge 172. Rear panel 126 laterally extends away from longitudinal fold line 152 in a direction opposite front panel 124 to a longitudinal fold line 154. In one embodiment, interior bottom panel 130 laterally extends from longitudinal fold line 154 to a free longitudinal edge 156. In one example, each of fold lines 150, 152, 154, and 170 and free longitudinal edges 156 and 172 are substantially linear and/or extend substantially parallel to one another.

A plurality of cutouts 158 are formed to extend from longitudinal fold line 154 into interior bottom panel 130 and are longitudinally spaced along longitudinal fold line 154 such that longitudinal fold line 154 may be discontinuous, in one example. Each cutout 158 has a small lateral dimension and a larger longitudinal dimension. To correspond with cutout 158, bottom securement tabs 134 extend away from longitudinal free edge 172. Accordingly, longitudinal fold lines 174 are formed between each bottom securement tab 134 and exterior bottom panel 132 to be collinear with longitudinal free edge 172. Each bottom securement tab 134 has a longitudinal dimension substantially identical to (e.g., just slightly smaller than) a corresponding one of cutouts 158 and is longitudinally positioned to correspond with one of cutouts 158. When sign 18 is folded, each bottom securement tab 134 will be received within the corresponding different one of cutouts 158 as will be further described below.

Interior bottom panel 130 additionally defines interior bracket receiving cutouts or apertures 160. Each interior bracket-receiving aperture 160 is substantially L-shaped and has a cutout width substantially equal to (e.g., just slightly greater than) a width of each of intermediate wall 72, first sidewall 74 and second sidewall 76. In one example, a first linear segment of interior bracket-receiving aperture 160 has a boundary edge extending substantially collinearly with fold line 154 and a second linear segment extends to longitudinal free edge 156. In embodiments not illustrated, where interior bottom panel has a larger lateral dimension, interior bracket-receiving aperture 160 may be substantially C-shaped rather than substantially L-shaped. Each linear segment is sized and shaped to slidably receive a different one of intermediate wall 72, first sidewall 74, and second sidewall 76 of one of brackets 30.

Exterior bottom panel 132 additionally defines exterior bracket receiving cutouts or apertures 176. Each exterior bracket-receiving aperture 176 is substantially C-shaped and has a cutout width substantially equal to (e.g., just slightly greater than) a width of each of intermediate wall 72, first sidewall 74 and second sidewall 76 of bracket 30. As such, in one example, a size and a shape of the exterior bracket-receiving apertures 176 are substantially identical to a size and a shape of a cross-section of sign reception portion 36 of bracket 30. In one example, a first linear segment of exterior bracket-receiving aperture 176 has a boundary edge extending substantially collinearly with fold line 170, a second linear segment extends to perpendicularly between the first linear segment and a third linear segment, and the third linear segment has a boundary edge extending substantially collinearly with free longitudinal edge 172. Each linear segment of exterior bracket-receiving aperture 176 is sized and shaped to slidably receive a different one of intermediate wall 72, first sidewall 74, and second sidewall 76 of one of brackets 30.

In one example, each of front panel 124, rear panel 126, and top panel 128 longitudinally extends between opposing lateral fold lines 180, which, in one embodiment, are each substantially linear and/or extend substantially parallel with one another. Interior side panels 136 each extend from a portion of lateral fold lines 180 opposite one of front panel 124 and rear panel 126, for example, rear panel 126 as illustrated in FIG. 11, to a lateral free end 182. Each interior side panel 136 has a lateral dimension substantially equal to a lateral dimension of the corresponding front panel 124 or rear panel 126. Exterior side panels 138 each extend from a portion of lateral fold lines 180 opposite the other one of front panel 124 and rear panel 126, for example, front panel 124 as illustrated in FIG. 11, to a lateral free edge 184. Each exterior side panel 138 has a lateral dimension substantially equal to a lateral dimension of the corresponding front panel 124 or rear panel 126.

In one example, a plurality of cutouts 186 are formed to extend from fold line 180 into interior side panel 136 and are laterally spaced along fold line 180 such that fold line 180 may be discontinuous, in one example. Each cutout 184 has a small longitudinal dimension and a larger lateral dimension. To correspond with cutouts 184, bottom securement tabs 140 extend away from lateral free edge 184. Fold lines 188 are formed between each side securement tab 140 and exterior side panel 138 to be collinear with lateral free edge 184. Each side securement tab 140 has a lateral dimension substantially identical to (e.g., just slightly smaller than) a corresponding one of cutouts 184 and is laterally positioned to correspond with one of cutouts 184. When sign 18 is folded, each side securement tab 140 will be received within the corresponding different one of cutouts 184 as will be further described below. In one embodiment, sign 18 additionally includes topside tabs 190 each extending from opposing fold lines 190 adjacent top panel 128 to a lateral free edge 192.

Figure 12:
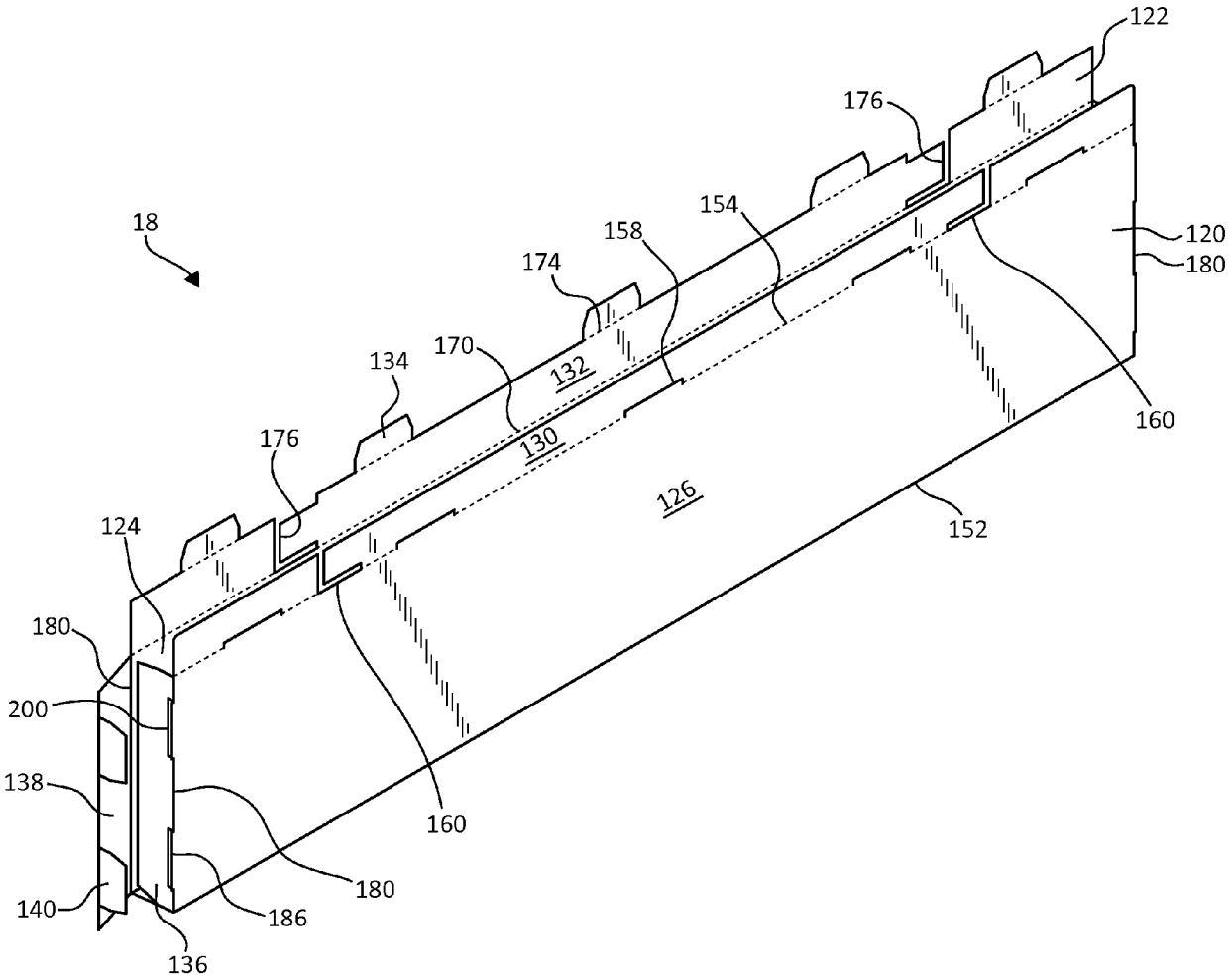
FIG. 12 is a bottom, perspective view illustration of a partially assembled sign, according to one embodiment of the present invention.
Figure 13:
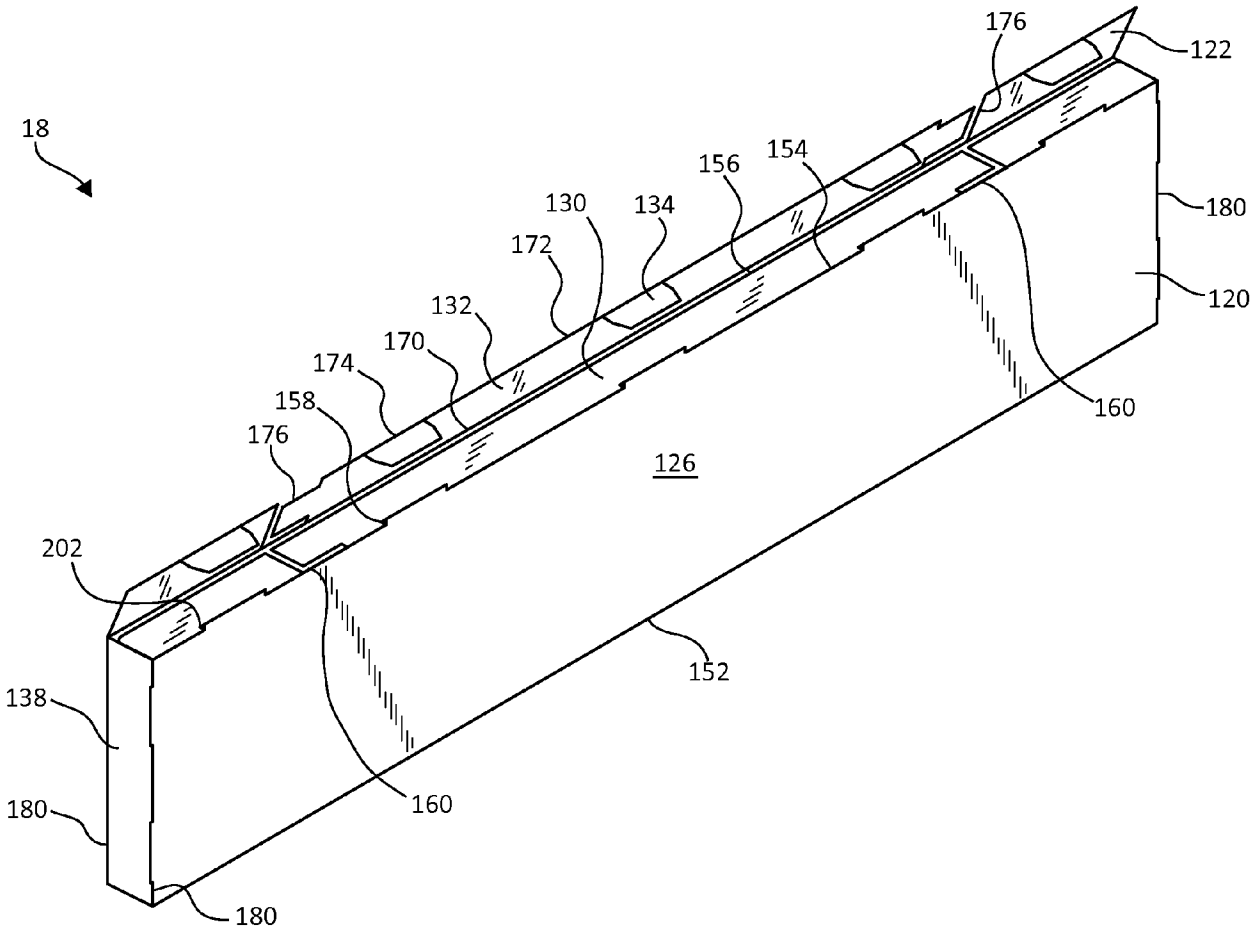
FIG. 13 is a bottom, perspective view illustration of a partially assembled sign, according to one embodiment of the present invention.
Figure 14:
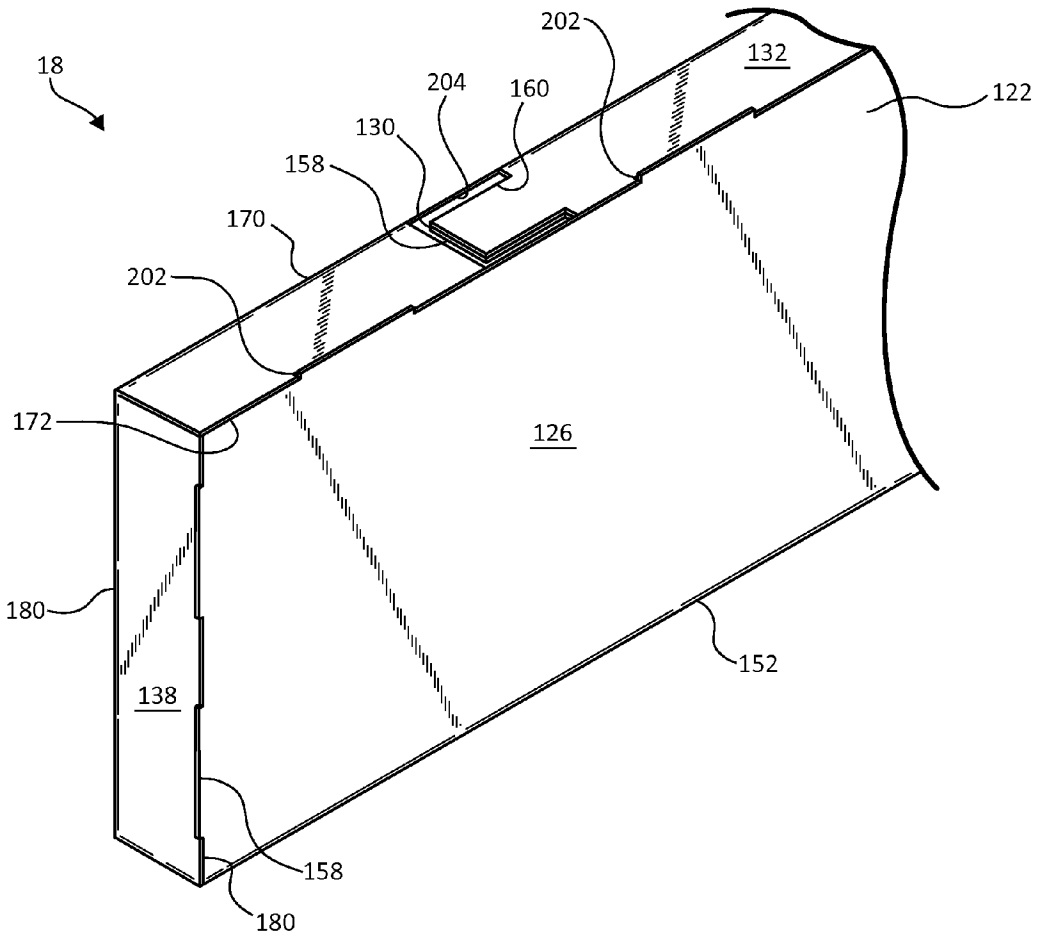
FIG. 14 is an enlarged, partial bottom perspective view illustration of an assembled sign, according to one embodiment of the present invention.

As illustrated in FIGS. 12-14, sign 18 is assembled by folding along each of longitudinal fold lines 150, 152, 154, and 170 and lateral fold lines 180 into cuboid form and secured in such form via sliding bottom securement tabs 134 into openings created adjacent cutouts 158 and sided securement tabs 140 into opening created adjacent cutouts 186. More specifically, in one example, as illustrated in FIG. 12, exterior surface 120 is initially placed face down, and front panel 124 and rear panel 126 are each folded toward each other about respective longitudinal fold lines 150 and 153 to extend substantially perpendicularly relative to top panel 128 (FIG. 11). Each of interior side panels 136 is folded toward front panel 124 about a portion of a respective lateral fold line 180. Due to the plurality of cutouts 186 and such folding about fold lines 180, slots 200 are formed in each interior side panel 136 immediately adjacent the corresponding fold line 180. Side securement tabs 140 are folded away from exterior surface 120 about lateral fold lines 188. Additionally referring to FIG. 13, exterior side panels 138 are folded away from exterior surface 120 about portions of the respective lateral fold lines 180 such that side securement tabs 140 are each slid into a corresponding slot 200. Interaction between side securement tabs 140 and portions of interior side panels 136 adjacent slots 200 frictionally maintains exterior side panels 138 in place, e.g., in a manner extending substantially perpendicularly relative to each of front panel 124 and rear panel 126 as shown in FIG. 13.

Next, as illustrated in FIG. 13, interior bottom panel 130 is folded away from exterior surface 120 to extend substantially perpendicularly relative to each of front panel 124 and rear panel 126, for example, to extend substantially parallel to top panel 128 (FIG. 11). Due to cutouts 158, in so folding interior bottom panel 130, slots 202 are formed a in each interior bottom panel 130 adjacent longitudinal fold line 154 and each cutout 158. Bottom securement tabs 134 and exterior side panel 132 are folded away from exterior surface 120 about longitudinal fold lines 174 and 170, respectively. In so folding exterior side panel 132, each of bottom securement tabs 134 slides into a corresponding one of slots 202 in interior bottom panel 130. Interaction between bottom securement tabs 134 and portions of interior bottom panel 130 adjacent slots 20*s* frictionally maintains exterior bottom panel 132 in place, e.g., in a manner extending substantially perpendicularly relative to each of front panel 124 and rear panel 126 as shown in FIG. 14.

Referring to FIGS. 13 and 14, upon securement of exterior bottom panel 132 to interior bottom panel 130, each interior bracket-receiving aperture 160 aligns with a different one of exterior bracket-receiving apertures 176 to collectively define a bottom opening 204. Sign 18 is inverted such that exterior surface 120 of exterior bottom panel 132 faces downwardly and exterior surface 120 of top panel 128 faces upwardly. Sign 18 is moved relative to brackets 30 positioned on a corresponding gondola unit 12, 14, or 16 as illustrated with additional reference to FIG. 15. More specifically, each sign 18 is placed above brackets 30 in a manner laterally and longitudinally aligning sign reception portion 36 of each bracket with a corresponding one of bottom openings 204. Downward movement, e.g., as generally illustrated by arrow 206 in FIG. 15, of sign 18 slides sign 18 over brackets 30 with at least sign reception portion 36 of brackets 30 moving into and being substantially entirely enclosed within an internal cavity 208 of sign 18 defined between front panel 24, rear panel 26, top panel 28, interior bottom panel 130, and interior side panels 136 as further shown in the cross-sectional view of FIG. 16.

When so positioned, first side panel 74 and second side panel 76 are each tightly maintained against interior surfaces 122 of a different one of front panel 124 and rear panel 126 as the overall width of sign reception portion 36 of bracket 30 is substantially equal to an width of internal cavity 208. In one embodiment, linear edges of internal bottom panel 130 and section bottom panel 132 adjacent sign-receiving apertures 160 and 176 each directly abut a corresponding one of intermediate wall 72, first sidewall 74, second sidewall 76, for example, within open channel 78 (FIG. 1) defined by sign-receiving apertures 160. Interaction of sign 18 with surfaces of intermediate wall 72, first sidewall 74, and second sidewall 76 within open channel 78 provides additional linear and rotational stability to sign 18 on bracket 30 further contributing to the overall stability of the display system 10 (FIG. 1). In another embodiment, signs 18 fit lower on bracket 30, such that external bottom panel 132 sits on a top surface of substantially planar panel 40, with external bottom panel 132 and internal bottom panel 130 generally being positioned below bottom edges 90 of first sidewall 74 and second sidewall 76. By using two or more brackets 30 for longer signs 18, even elongated sign 18 can be securely maintained on top of each gondola unit 12, 14, and/or 16. Sign(s) of the resultant display system 10 draw attention and providing consumer/viewer information related to goods on the corresponding gondola unit(s) 12, 14, and/or 16.

Figure 15:
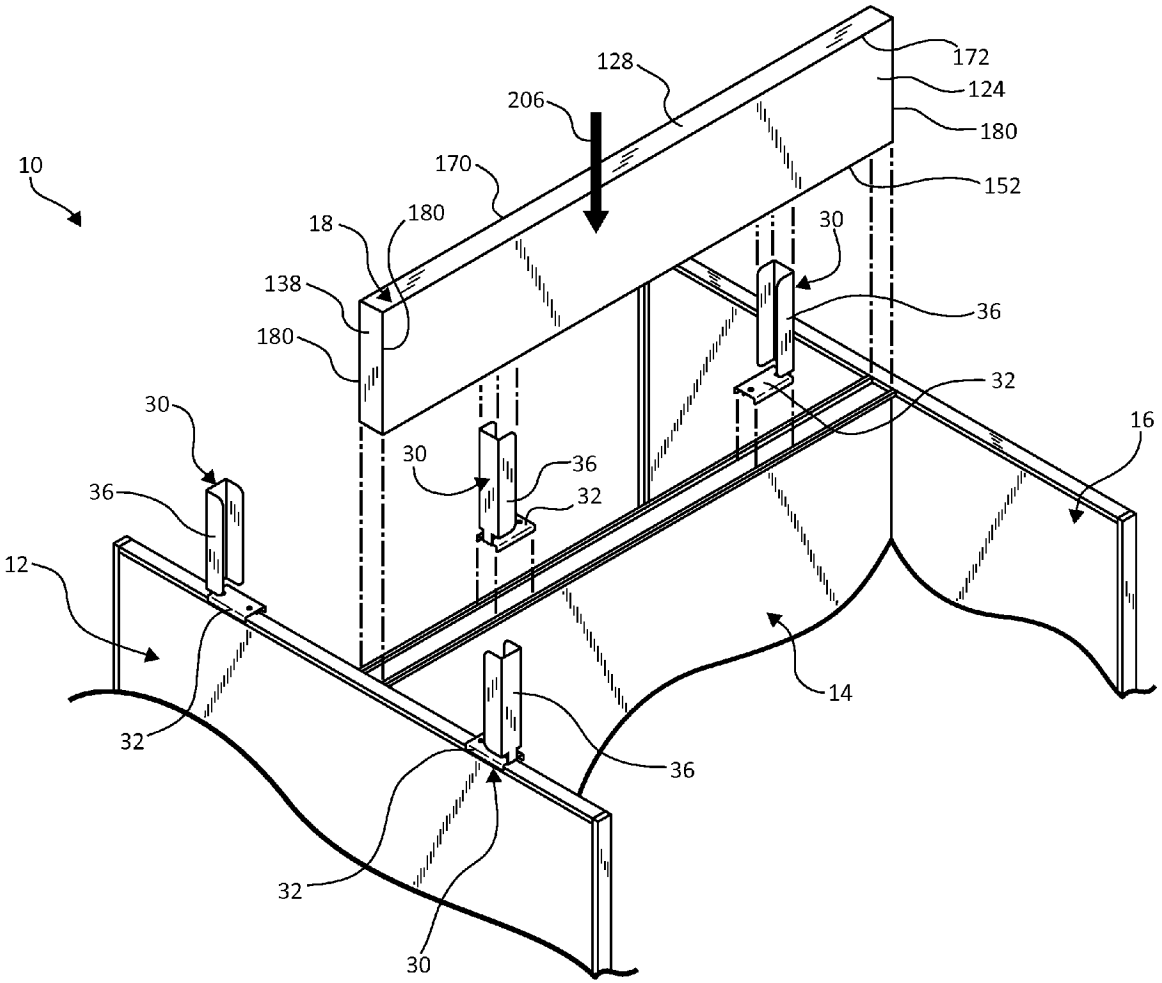
FIG. 15 is a partial, exploded, front perspective view illustration of the display system of FIG. 1, according to one embodiment of the present invention.
Figure 16:
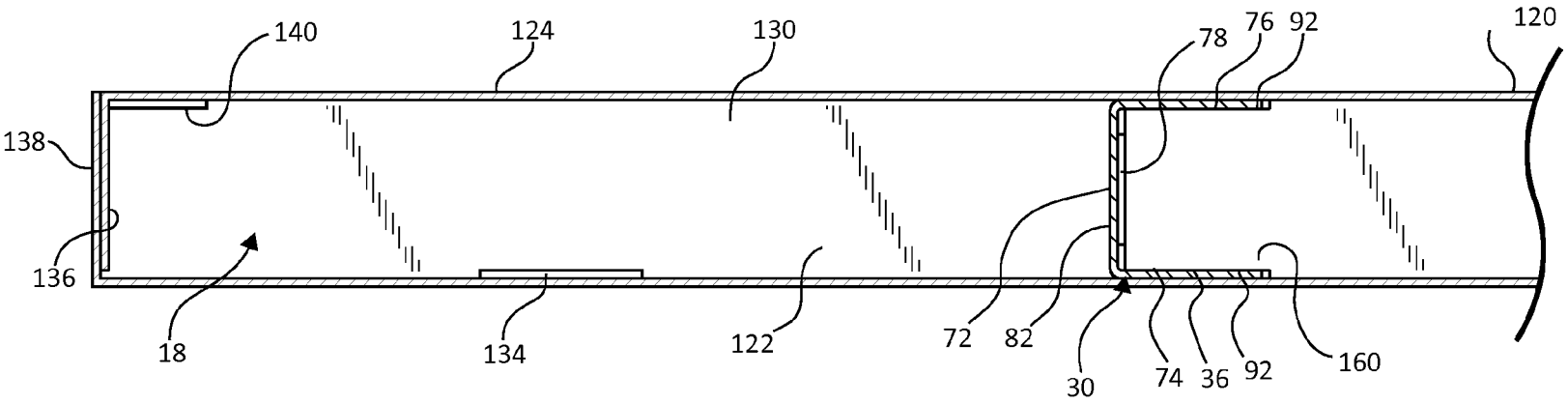
FIG. 16 is a partial cross-sectional view illustration taken along the line C-C in FIG. 1, according to one embodiment of the present invention.

While described above as assembling sign 18 in a particular sequence with respect to FIGS. 12-14, other sequences of folding various portions of sign 18 are also contemplated fall within the scope of the present invention. In addition, while a particular arrangement of gondola units 12, 14, and 16 is illustrated in FIGS. 1 and 15, bracket(s) 30 and sign(s) 18 may also be used with a single gondola unit or a plurality of gondola units in any variety of configurations as will be apparent to those of skill in the art. Still further, bracket(s) 30 and sign(s) 18 may alternatively be used to top other displays not considered to be gondola units 12, 14, and 16 such as clothes hanging racks, tables, support bars, etc. Other variations are also contemplated within the scope of the present invention.

Installing signs as disclosed above provides an easily assembled, non-permanent, stable yet easily disassembled display system. No additional fasteners are required and brackets are configured for repeated use. In addition, upon installation, brackets are substantially hidden from view by the sign so as to decrease any aesthetic distraction to consumers or other viewers. Due at least in part to the strength of the magnets on the brackets, the signs are stable and not readily inadvertently removed from the corresponding gondolas. However, the strength of the magnets can readily be overcome when one purposefully removes sign and/or brackets from the gondola displays. Signs may additionally be mounted to metallic or suitably magnetic surfaces that are not part of gondola units using brackets.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. For example, while the cross-section of the sign reception portion and the bracket receiving apertures are each primarily described as being C-shaped, in other embodiments, the cross-section of the sign reception portion and the bracket receiving apertures have other suitable shapes such as H-shapes. Furthermore, there is no intention to be bound by any theory presented in the preceding background of the invention or the above detailed description.

What is claimed is:

1. A display system comprising:

a bracket including:

a base, and a sign reception portion coupled to the base, the sign reception portion including a first sidewall, a second sidewall, and an intermediate wall, the first sidewall and the second sidewall each extending from opposing longitudinal sides of the intermediate wall over the base; and a sign including a front panel, a rear panel, and a bottom panel, the rear panel being spaced from the front panel to define an internal cavity between the front panel and the rear panel, the bottom panel extending between the front panel and the rear panel, and the bottom panel defining an aperture, wherein:

the sign reception portion of the bracket slides into the internal cavity via the aperture, and each of the first sidewall and the second sidewall of the sign reception portion abuts an internal surface of a different one of the front panel and the rear panel of the sign to frictionally maintain the sign above the base, the first sidewall, the second sidewall, and the intermediate wall collectively define the sign reception portion to have a cross-section, and the aperture is sized and shaped substantially identically to the cross-section of the sign reception portion.

2. The display system of claim 1, wherein each of the aperture and the cross-section are substantially C-shaped.

3. The display system of claim 1, wherein:

the base defines a substantially planar panel, and the bottom panel of the sign rests directly on the substantially planar panel of the base.

4. The display system of claim 1, wherein:

the bracket is one of two or more brackets, each of the two or more brackets is substantially identical to the other ones of the two or more brackets, the aperture is one of two or more apertures, and each of the two or more brackets is received by the sign via a different one of the two or more apertures.

5. The display system of claim 4, wherein the internal cavity of the sign is substantially entirely enclosed by the sign other than the two or more apertures.

6. The combination of claim 1, wherein the sign is formed as a single piece of a substantially planar material folded to define the front panel, the rear panel, and the bottom panel.

7. The display system of claim 1, wherein the base and the sign reception portion are formed from and remain a single piece of material.

8. The display system of claim 7, wherein the material is sheet metal bent to form the base and the sign reception portion.

9. The display system of claim 1, wherein the bracket includes a magnet secured to a bottom surface of the base.

10. The display system of claim 9, wherein:

the base defines a substantially planar panel, the base includes depending base sidewalls each extending from an opposing side of the substantially planar panel, and the magnet is positioned between the depending base sidewalls.

11. The display system of claim 9, wherein the magnet is rated to withstand at least 25 pounds of pull.

12. The display system of claim 1, further comprising a gondola unit having a top spine, wherein the base of the bracket is selectively coupled with the top spine of the gondola unit.

13. The display system of claim 12, wherein the base includes a magnet, and the bracket is secured to the top spine via magnetic force from the magnet.

14. The display system of claim 1, wherein:

the base defines a substantially planar panel, the intermediate wall extends from an end of the substantially planar panel of the base upwardly away from the base, the opposing longitudinal sides of the intermediate wall extend substantially perpendicularly to the substantially planar panel of the base, the first sidewall extends from one of the opposing longitudinal sides of the intermediate wall in a first sidewall plane substantially perpendicular to each of the substantially planar panel of the base and the intermediate wall of the sign reception portion, and the second sidewall extends from the other of the opposing longitudinal sides of the intermediate wall in a second sidewall plane substantially perpendicular to each of the substantially planar panel of the base and the intermediate wall of the sign reception portion and substantially parallel to the first sidewall.

15. A display system comprising:

a bracket including:

a base, and a sign reception portion coupled to the base, the sign reception portion including a first sidewall, a second sidewall, and an intermediate wall, the first sidewall and the second sidewall each extending from opposing longitudinal sides of the intermediate wall over the base; and a sign including a front panel, a rear panel, and a bottom panel, the rear panel being spaced from the front panel to define an internal cavity between the front panel and the rear panel, the bottom panel extending between the front panel and the rear panel, and the bottom panel defining an aperture, wherein:

the sign reception portion of the bracket slides into the internal cavity via the aperture, each of the first sidewall and the second sidewall of the sign reception portion abuts an internal surface of a different one of the front panel and the rear panel of the sign to frictionally maintain the sign above the base, the base defines a substantially planar panel, the bracket includes a neck extending from a first edge of the substantially planar panel to a bottom edge of the intermediate wall in a manner spacing the sign reception portion from the base, and each of the first sidewall, the second sidewall, and the intermediate wall extend substantially perpendicularly relative to the substantially planar panel.

16. The display system of claim 15, wherein the neck has a smaller width than a width of the substantially planar panel and than a width of the intermediate wall of the sign reception portion.

17. A display system comprising:

a sign holder bracket including:

a base, and an elongated top extension portion coupled to the base, the elongated top extension portion including a first sidewall, a second sidewall, and an intermediate wall, the first sidewall and the second sidewall each extending from opposing longitudinal sides of the intermediate wall over the base to collectively define the elongated top extension portion to have a C-shaped cross-section; and a sign including a front panel, a rear panel spaced from the front panel to define an internal cavity between the front panel and the rear panel, and a bottom panel extending between the front panel and the rear panel, the bottom panel defining a substantially C-shaped aperture, wherein the elongated top extension portion of the sign holder bracket slides into the internal cavity via the C-shaped aperture, and each of the first sidewall and the second sidewall of the elongated top extension portion abuts an internal surface of a different one of the front panel and the rear panel of the sign to frictionally maintain the sign above the base.

18. The display system of claim 17, wherein the substantially C-shaped aperture is sized and shaped substantially identically to the C-shaped cross-section of the elongated top extension portion.

19. The display system of claim 17, wherein:

the base defines a substantially planar panel, and the bottom panel of the sign rests directly on the substantially planar panel of the base.

20. The display system of claim 17, wherein:

the sign holder bracket is one of two or more sign holder brackets, each of the two or more sign holder brackets is substantially identical to the other ones of the two or more sign holder brackets, the C-shaped aperture is one of two or more C-shaped apertures, and each of the two or more sign holder brackets is received by the sign via a different one of the two or more C-shaped apertures.

21. The display system of claim 20, wherein the internal cavity of the sign is substantially entirely enclosed within the sign other than the two or more C-shaped apertures.

22. The display system of claim 17, wherein:

the sign holder bracket includes a magnet secured to a bottom surface of the base, and bracket is secured to the top spine via magnetic force from the magnet.

23. A method of coupling installing a sign in a display system, the method comprising:

providing a bracket including:

a base, and a sign reception portion coupled to the base, the sign reception portion including a first sidewall, a second sidewall, and an intermediate wall, the first sidewall and the second sidewall each extending from opposing longitudinal sides of the intermediate wall over the base;

coupling a sign to the bracket, the sign including a front panel, a rear panel spaced from the front panel to define an internal cavity between the front panel and the rear panel, and a bottom panel extending between the front panel and the rear panel, the bottom panel defining an aperture, wherein coupling the sign to the bracket includes sliding the sign reception portion of the bracket through the aperture, in a direction substantially perpendicular to the bottom panel, and into the internal cavity such that each of the first sidewall and the second sidewall of the sign reception portion abuts an internal surface of a different one of the front panel and the rear panel of the sign to frictionally maintain the sign above the base.

24. The method of claim 23, further comprising securing the base of the bracket to a top spine of a display unit via a magnet on the base of the bracket.

* * * * *